US006495954B1

(12) United States Patent
Lee et al.

(10) Patent No.: US 6,495,954 B1
(45) Date of Patent: Dec. 17, 2002

(54) CATHODE RAY TUBE HAVING REDUCTION IN DEFLECTION POWER CONSUMPTION RELATIVE TO FUNNEL CONDITION

(75) Inventors: Bong-Woo Lee, Kyungki-do (KR); Do-Nyun Kim, Kyungki-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 117 days.

(21) Appl. No.: 09/586,871

(22) Filed: Jun. 5, 2000

(30) Foreign Application Priority Data

Jun. 7, 1999 (KR) ..... 99-20981

(51) Int. Cl.[7] ..... H01J 31/00
(52) U.S. Cl. ..... 313/477 R; 313/440; 313/442
(58) Field of Search ..... 313/477 R, 440, 313/442

(56) References Cited

U.S. PATENT DOCUMENTS 2,821,671 A * 1/1958 Kratz et al. ..... 335/213
4,874,982 A * 10/1989 Overdijk et al. ..... 313/440
5,059,858 A * 10/1991 Shimona et al. ..... 313/440
6,188,173 B1 * 2/2001 Kang et al. ..... 313/472
6,384,525 B1 * 5/2002 Sano et al. ..... 313/440
6,396,204 B1 * 5/2002 Park et al. ..... 220/2.1 A

* cited by examiner

*Primary Examiner*—Nimeshkumar D. Patel
*Assistant Examiner*—Glenn Zimmerman
(74) *Attorney, Agent, or Firm*—Christie, Parker & Hale, LLP

(57) ABSTRACT

A cathode ray tube with a central axis includes a panel with an inner phosphor screen, and a funnel connected to the panel. The funnel has a cone portion with a neck sealing side, and a body portion extended from the cone portion to the panel. A deflection yoke is externally mounted around the funnel. A neck is connected to the neck sealing side of the cone portion. An electron gun is mounted within the neck. The funnel is structured to satisfy the following condition:

$$-0.145<H/L-(0.0225\times\alpha)<0.08$$

where H indicates the distance between opposite points at the top of round on a line drawn to be normal to the tube axis line, L indicates the distance between the top of round and the neck sealing side of the cone portion on the tube axis line, and α indicates the deflection angle (degree).

1 Claim, 1 Drawing Sheet

CATHODE RAY TUBE HAVING REDUCTION IN DEFLECTION POWER CONSUMPTION RELATIVE TO FUNNEL CONDITION

FIELD OF THE INVENTION

The present invention relates to a cathode ray tube (CRT) and, more particularly, to a CRT that can reduce power consumption for deflecting electron beams by improving the structural characteristics of a funnel.

BACKGROUND OF THE INVENTION

Generally, CRTs include a panel having an inner phosphor screen, a funnel having a cone portion, and a neck having an electron gun which are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land on the phosphor screen.

Recently, the CRTs have been employed for use in highly sophisticated electronic devices such as high definition television (HDTV) and OA equipment. On the one hand, in these applications, the consumption power of the CRT should be reduced to obtain good energy efficiency, and the leakage magnetic field due to the power consumption should be reduced to protect the user from the harmful electronic waves. In order to meet these requirements, the consumption power of the deflection yoke, which is the major consumption source, should be reduced in a suitable manner.

On the other hand, in order to realize high brightness and resolution of display images on the screen, the deflection power of the deflection yoke should be increased. Specifically, higher anode voltage is required to enhance the brightness of the screen and correspondingly, higher deflection voltage is required to deflect the electron beams accelerated by the increased anode voltage. Furthermore, higher deflection frequency is required to enhance the resolution of the screen, and this accompanies the requirement of increased deflection power. In addition, in order to realize relatively flat CRTs for more convenient use, wide-angle deflection should be performed with respect to the electron beams. This also accompanies the requirement of increased deflection power.

In this situation, there is a need for a technique that allows for CRTs that retain good deflection efficiency while constantly maintaining or reducing the deflection power.

For this purpose, conventionally, the deflection efficiency is increased by positioning the deflection yoke more adjacent to the electron beam paths. The positioning of the deflection yoke is usually achieved by reducing a diameter of the neck. However, in such a technique, as the diameter of the neck is reduced, the size of the electron gun to be mounted within the neck and the curvature of the funnel to be connected to the neck should be correspondingly varied, and this results in complicated processing steps. Furthermore, in such a structure, the focusing characteristic of the electron gun is poor.

Alternatively, in order to reduce the deflection power consumption, it has been suggested that the diameter of the neck be constantly kept to be about 29.1 mm, and instead of reducing the diameter of the neck, this technique reduces the neck-sided outer diameter of the funnel. However, in such a structure, the electron beams applied onto the screen corner portions are liable to bombard the inner wall of the funnel adjacent to the neck. This phenomenon is usually called the "beam shadow neck" or briefly the "BSN". Consequently, the phosphors coated on the corresponding screen corner portions are not excited, and it becomes difficult to obtain good quality screen images.

In short, the techniques for decreasing the deflection power consumption simply by reducing the diameter of the neck or the neck-sided outer diameter of the funnel necessarily involve the beam shadow neck or other device failures. They cannot correctly examine the practical moving routes of the electron beams on the basis of appropriate measurement procedures.

SUMMARY OF THE INVENTION

It is an object of the present invention to provide a CRT that effectively reduces power consumption for deflecting electron beams without involving any beam shadow neck.

This and other objects may be achieved by a CRT with a central axis. The CRT includes a panel with an inner phosphor screen and a funnel connected to the panel. The funnel has a cone portion with a neck sealing side and a body portion extended from the cone portion to the panel. A deflection yoke is externally mounted around the funnel. A neck is connected to the neck sealing side of the cone portion. An electron gun is mounted within the neck.

The meeting point between the cone portion and the body portion is indicated by a top of round (TOR) . At this connection, the funnel is structured to satisfy the following condition:

$$-0.145<H/L-(0.0225\times\alpha)<0.08$$

where H indicates the distance between opposite points at the top of round TOR on a line drawn normal to the central axis, L indicates the distance between the top of round TOR and the neck sealing side of the cone portion on the central axis, and $\alpha$ indicates the deflection angle (degree).

DESCRIPTION OF THE DRAWING

A more complete appreciation of the invention, and many of the attendant advantages thereof, will be better understood by reference to the following detailed description when considered in conjunction with the accompanying drawing, wherein.

DETAILED DESCRIPTION

Figure 1:
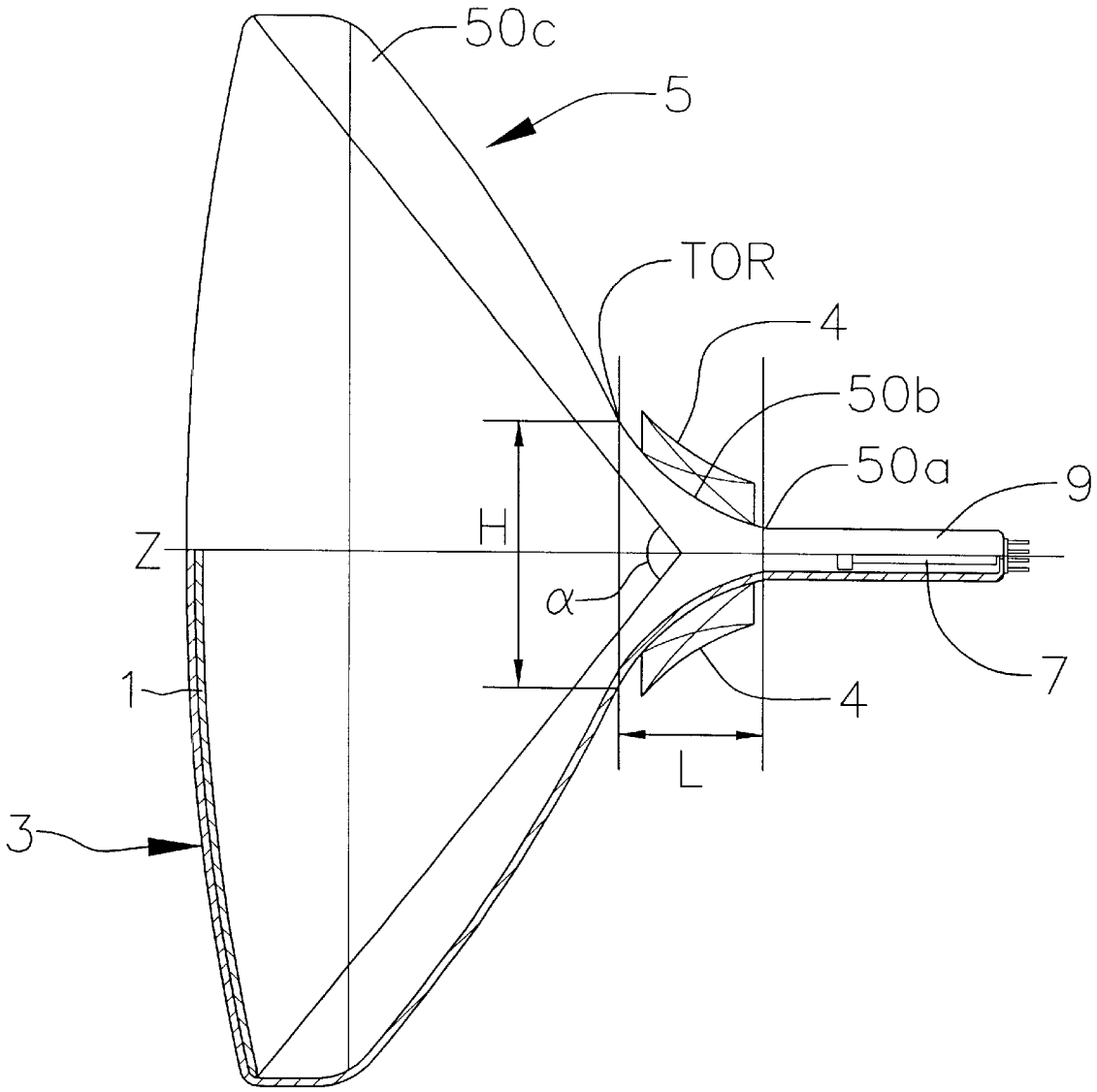
FIG. 1 is a side-half sectional view of a CRT according to a preferred embodiment of the present invention.

Preferred embodiments of this invention will be explained with reference to the accompanying drawing.

FIG. 1 is a side-half sectional view of a CRT with a central axis Z according to a preferred embodiment of the present invention. As shown in FIG. 1, the CRT includes a faceplate panel 3 with an inner phosphor screen 1 and a rear portion. The phosphor screen 1 is substantially rectangular-shaped with four diagonal edges. A funnel 5 is connected to the rear portion of the panel 3, and a deflection yoke 4 is externally mounted around the funnel 5. The funnel 5 is in turn connected to a neck 9 that is internally mounted with an electron gun 7.

Specifically, the funnel 5 has a cone portion 50*b* with a neck sealing side 50*a* to which the neck 9 is sealed, and a body portion 50*c* that becomes larger as it extends from the cone portion 50*b* to the panel 3.

The meeting point between the cone portion 50*b* and the body portion 50*c* becomes an inflection point where the inner curved surface of the funnel 5 changes from depression (corresponding to the body portion 50*c*) to prominence (corresponding to the cone portion 50*b*) . Such an inflection point is usually called the "top of round (TOR)".

At this connection, the funnel 5 is structured to satisfy the following condition:

$$-0.145<H/L-(0.0225\times\alpha)<0.08$$

where H indicates the distance between the opposite points at the top of round TOR on a line drawn t o be normal to the central axis Z, L indicates the distance between the top of round TOR and the neck sealing side 50*a* of the cone portion 50*b* on the central axis Z, and a indicates the deflection angle (degree).

A 17-inch CRT having the above structure, though other sized CRTs may be also applied, was made. The structural characteristics of this CRT were compared with those of a same-sized CRT according to the prior art. The results are listed in Table 1 where X=H/L−(0.0225×α).

TABLE 1 where X = H/L − (0.0225 × α).

| | Size(inch) | L(mm) | H(mm) | α (degree) | X |
|---|---|---|---|---|---|
| Present | 17 | 74.44 | 152.40 | 90 | 0.02 |
| Prior | 17 | 88.40 | 152.40 | 90 | −0.30 |

As indicated in Table 1, when the funnel 5 is structured to satisfy t her above condition, the distance L between the top of round TOR and the neck sealing side 50*a* on the central axis Z is reduced compared to that of the conventional CRT. This means that the deflection yoke mounted around the cone portion 50*b* becomes closer to the moving routes of the electron beams. Practically, in the above structure, the reduction in deflection power consumption of the 17-inch CRT re ached up to 9.76%.

In the above structural condition, when X (H/L−(0.0225×α)) is lower than −0.145, the desired reduction in deflection power consumption cannot be obtained. In contrast, when X is higher than 0.08, there is a possibility that the beam shadow neck BSN would occur.

As described above, the inventive CRT can effectively reduce deflection power consumption without involving any beam shadow neck.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A cathode ray tube with a central axis, the cathode ray tube comprising:

a panel with an inner phosphor screen, the phosphor screen being substantially rectangular-shaped with four diagonal edges;

a funnel connected to the panel, the funnel having a cone portion with a neck sealing side, and a body portion extended from the cone portion to the panel;

a deflection yoke externally mounted around the funnel;

a neck connected to the neck sealing side of the cone portion; and an electron gun mounted within the neck;

wherein the meeting point between the cone portion and the body portion is indicated by a top of round; and wherein the funnel is structured to satisfy the following condition:

$$-0.145<H/L-(0.0225\times\alpha)<0.08$$

where H indicates a distance in millimeter between opposite points at the top of round on a line drawn normal to the central axis, L indicates a distance in millimeter between the top of round and the neck sealing side of the cone portion on the central axis, and α indicates a deflection angle in degrees.

* * * * *